US006950295B2

(12) United States Patent
Vo et al.

(10) Patent No.: US 6,950,295 B2
(45) Date of Patent: Sep. 27, 2005

(54) METHOD AND APPARATUS FOR BALANCING CAPACITANCE IN HYBRID OVERVOLTAGE PROTECTION DEVICE

(75) Inventors: Chanh C. Vo, Arlington, TX (US); John J. Napiorkowski, Irving, TX (US); Barry G. Slotnick, Plano, TX (US)

(73) Assignee: Corning Cable Systems LLC, Hickory, NC (US)

( * ) Notice: Subject to any disclaimer, the term of this patent is extended or adjusted under 35 U.S.C. 154(b) by 402 days.

(21) Appl. No.: 10/322,112

(22) Filed: Dec. 17, 2002

(65) Prior Publication Data

US 2004/0100747 A1 May 27, 2004

Related U.S. Application Data

(63) Continuation-in-part of application No. 10/304,150, filed on Nov. 26, 2002.

(51) Int. Cl.[7] ..... H02H 1/00
(52) U.S. Cl. ..... 361/126
(58) Field of Search ..... 361/126

(56) References Cited

U.S. PATENT DOCUMENTS 4,802,055 A * 1/1989 Beckerman ..... 361/56
4,931,901 A * 6/1990 Heron, Jr. ..... 361/321.2
5,142,430 A * 8/1992 Anthony ..... 361/56
5,557,065 A 9/1996 Brower et al. ..... 174/52.3
5,623,388 A * 4/1997 Chaudhry ..... 361/119
5,854,730 A * 12/1998 Mitchell et al. ..... 361/38
5,880,919 A 3/1999 Napiorkowski et al. .... 361/117
6,188,557 B1 * 2/2001 Chaudhry ..... 361/111
6,195,245 B1 2/2001 Kobsa ..... 361/120
6,226,166 B1 * 5/2001 Gumley et al. ..... 361/118
6,327,129 B1 12/2001 Oertel et al. ..... 361/118
6,421,218 B1 7/2002 Vo et al. ..... 361/117
6,421,220 B2 7/2002 Kobsa ..... 361/120
6,680,839 B2 * 1/2004 Napiorkowski ..... 361/119
6,785,110 B2 * 8/2004 Bartel et al. ..... 361/119

* cited by examiner

*Primary Examiner*—Stephen W. Jackson
*Assistant Examiner*—James A. Demakis
(74) *Attorney, Agent, or Firm*—Christopher C. Dremann

(57) ABSTRACT

Metal oxide varistors (MOVs) are employed in surge protection devices, such as overvoltage protection devices, between a pair of signal lines and ground to reduce the capacitive imbalance introduced by the overvoltage protector, thereby improving higher frequency transmissions over twisted-pair telephone lines. The MOVs are sorted into subgroups having a capacitive tolerance of no more than about 1.0 picofarad. MOVs with asymmetrical electrodes can also be sorted to reduce both the capacitance and the capacitive tolerance of the MOVs. The sorted MOVs can then be electrically connected in parallel with a gas discharge tube on each signal line to produce an overvoltage protection device, for example a station protector for use at a customer premises, having a capacitive imbalance that does not exceed about 1.3 picofarads. The use of asymmetrical electrodes reduces the capacitance of the sorted MOVs to less than about 30 picofarads.

22 Claims, 6 Drawing Sheets

METHOD AND APPARATUS FOR BALANCING CAPACITANCE IN HYBRID OVERVOLTAGE PROTECTION DEVICE

CROSS-REFERENCE TO RELATED APPLICATION

This application is a continuation-in-part of U.S. patent application Ser. No. 10/304,150, filed Nov. 26, 2002, and assigned to the assignee of the present invention.

FIELD OF THE INVENTION

This invention is related to surge protection devices, and more particularly, overvoltage protection devices, that employ metal oxide varistors (MOVs) in station protectors, central office overvoltage protection devices, on-line overvoltage protection devices, and remote terminal overvoltage protection devices. In particular, this invention is related to the use of MOVs in hybrid overvoltage protection devices designed for higher frequency digital subscriber line (DSL) transmissions.

BACKGROUND OF THE INVENTION

Conventional overvoltage protection devices typically use a gas discharge surge arrestor, or "gas tube," as a primary means for diverting voltage surges from a signal line to ground. Examples of such devices are shown in U.S. Pat. Nos. 5,388,023, 5,500,782 and 5,880,919. Gas tubes dissipate energy by causing electrical arcing to ground. A gas of known dielectric strength is ionized when subjected to an electrical surge. One drawback of gas tubes, however, is that they typically exhibit a relatively slow response time, and thus, may not be able to safely suppress fast rise time voltage surges. Accordingly, metal oxide varistors (MOVs) have been employed as secondary protectors in back-up and interacting overvoltage protection devices. For example, in a conventional hybrid station protector, an MOV is electrically connected in parallel with the gas tube between each signal line and electrical ground. Although the gas tube can repeatedly dissipate voltage surges without damage, the response time of the MOV is substantially faster than the response time of the gas tube. Therefore, the MOV can be relied upon to shunt fast rise time voltage surges to ground, while the gas tube is relied upon to shunt sustained voltage surges, which might otherwise damage the MOV.

Overvoltage protection devices utilizing MOVs as secondary protectors have been successfully employed to protect conventional twisted-pair (i.e., "tip" and "ring") telephone lines. Broadband communications, such as digital subscriber line (DSL) transmissions, which are generically referred to herein as "xDSL", operate at transmission frequencies that are substantially higher than the frequencies traditionally employed over twisted-pair telephone lines. Presently, frequencies of at least 1 megahertz, and generally about 30 megahertz, are utilized for xDSL communications transmitted over twisted-pair telephone lines. Existing twisted-pair telephone lines, also referred to as outside plant wire, are typically CAT-3 grade or less and were not intended for high frequency performance when originally manufactured or installed. In many instances, conventional overvoltage protection devices are inadequate for higher frequency digital transmissions, for example VDSL. Even if only a small number of overvoltage protection devices perform inadequately, the cost of identifying and replacing the overvoltage protection devices that may be adequate for lower frequency xDSL communications, but inadequate for higher frequency xDSL communications, is significant.

The inadequate performance of some conventional overvoltage protection devices, such as station protectors utilized at customer premises for higher frequency xDSL communications, has been traced to the relatively high capacitance and the variability of the capacitance of the MOVs that are employed in the station protector. At higher frequencies, the capacitance and the variability of the capacitance results in unacceptable insertion loss, return loss, and longitudinal imbalance. It is well known that the capacitance can be reduced by utilizing MOVs of the same thickness, but having a smaller diameter. Many conventional station protectors employ 5 mm diameter MOVs with 3.8 mm electrodes on either side of the varistor material instead of smaller diameter MOVs because the larger diameter MOVs absorb additional energy without permanent damage. MOVs of this size with symmetrical electrodes have a capacitance of about 60 picofarads with a tolerance of about 20% (i.e., 60 picofarads ±12 picofarads). This relatively large tolerance is believed to be due to variability in the varistor material and thickness, and/or to the relative placement and size of the electrodes on opposite sides of the varistor material. Electrodes, which are intended to be aligned on opposite sides of the varistor material, can in practice be laterally displaced relative to each other. The concentricity of the two electrodes can also vary. Lateral displacement and varying concentricity of the electrodes on opposite sides of the varistor material means that the overlapped surface area of the electrodes can vary significantly between MOVs that are intended to be identical, thereby generating dissimilar electric fields that result in relatively high capacitive tolerance. The difference in the capacitances of the MOVs utilized between the tip conductor and ground and between the ring conductor and ground results in significant capacitance mismatch, referred to herein as "capacitive imbalance." In turn, excessive capacitive imbalance can cause unacceptable signal loss (e.g., insertion loss and return loss) and longitudinal imbalance at the higher frequencies utilized for xDSL communications transmitted over twisted-pair telephone lines.

As previously mentioned, it would be possible to reduce the capacitance between a signal line and ground in a station protector by utilizing an MOV of the same thickness having a smaller diameter. Because the electrodes of the smaller diameter MOV inherently have a smaller overlapped surface area, the smaller diameter MOV also has less capacitance. However, a smaller diameter MOV is not able to withstand the same sustained current as a larger diameter MOV. Furthermore, substitution of the smaller diameter MOV would result in significant engineering, re-tooling and testing expense. Even if the desired reduction in capacitance could be achieved by substituting a smaller diameter MOV for the 5 mm MOV presently in use, there could still be an excessive capacitive imbalance between the tip conductor and ground and the ring conductor and ground. Accordingly, it would be preferable if a reduction in the capacitive imbalance could be achieved without the need for extensive modifications to the present design of existing station protectors.

The number of station protectors and other overvoltage protection devices manufactured that are incapable of adequate performance at higher frequencies is significant, at least in the aggregate. In particular, when MOVs having relatively high capacitance and large capacitive tolerance are employed in twisted-pair telephone lines, an excessive imbalance in the capacitance between the tip conductor to ground signal line and the ring conductor to ground signal line will be present in a significant number of station protectors. In fact, a final inspection rejection rate as much as 10% is not uncommon. The capacitive imbalance for such station protectors has been found to be up to about 5 picofarads. For xDSL communications, a capacitive imbalance of less than about 1.3 picofarads is desired. Accordingly, what is needed is an overvoltage protection device in which the capacitive imbalance due to the capacitive tolerance of the MOVs utilized in the device is reduced, but in which the same current can be sustained without permanent damage to the MOVs. Such overvoltage protection devices, for example station protectors, could then be utilized without introducing an excessive capacitive imbalance in twisted-pair telephone lines that transmit higher frequency xDSL communications.

SUMMARY OF THE INVENTION

According to this invention, overvoltage protection devices for use with twisted-pair telephone lines can be manufactured such that the capacitive imbalance between the signal lines and electrical ground introduced by the overvoltage protection device does not adversely affect higher frequency transmissions, such as xDSL communications. These overvoltage protection devices, such as station protectors for interconnecting subscriber equipment at customer premises to a telephone network, can be assembled by a method including the following steps. A group of MOVs, each protecting against a surge of the same value, will exhibit levels of capacitance differing from other MOVs in the group by an amount greater than a predetermined first value of capacitive imbalance to be maintained by the overvoltage protection device. This large capacitive tolerance is due to manufacturing limitations and MOVs of the same type with the same rating will exhibit this variability. These MOVs are then sorted into subgroups, each subgroup consisting only of MOVs with capacitances differing by a predetermined second value, no greater than the predetermined first value. Individual overvoltage protection devices, such as station protectors, are then assembled using MOVs selected only from the same subgroup so that the capacitive imbalance of the station protector will not exceed the predetermined first value. A plurality of overvoltage protection devices assembled from MOVs selected from the same subgroup will still have a capacitive imbalance that does not exceed the predetermined first value, even though the capacitances of the MOVs in different overvoltage protection devices may differ significantly. Using this method, the remaining MOVs manufactured in the group of MOVs can be combined with MOVs manufactured in other groups to assemble station protectors despite the large capacitive tolerance exhibited by each group of MOVs.

According to another aspect of this invention, asymmetrical MOVs, each with electrodes having different surface areas, are also sorted. Such asymmetrical MOVs will necessarily have a lower capacitance and will exhibit less variability in capacitance. Thus, asymmetrical MOVs manufactured as part of the same production run can be sorted more efficiently than symmetrical MOVs of the same production run because of their smaller capacitive tolerance. Station protectors can then be manufactured using MOVs only from the same sorted subgroup and from the same production run. The capacitive imbalance of station protectors manufactured in this way will have both a reduced capacitance and a reduced capacitive imbalance.

DETAILED DESCRIPTION OF THE PREFERRED EMBODIMENTS

Preferred embodiments of the invention shown and described herein include surge protection devices, and in particular overvoltage protection devices, that are used at the interface between a telecommunications network and customer premises on twisted-pair telephone signal lines comprising conventional tip and ring conductors. Overvoltage protection devices, commonly referred to as station protectors, protect personnel and telecommunications equipment from voltage surges and overvoltage transients by shunting the voltage surges and transients to electrical ground. However, overvoltage protection devices according to the invention are not limited to station protectors, which are shown and described herein only as exemplary embodiments. Furthermore, other surge protection devices, such as central office overvoltage protection devices, on-line overvoltage protection devices, and remote terminal overvoltage protection devices can also benefit from the reduced capacitance and reduced capacitive imbalance achieved by this invention.

The present invention can be utilized on twisted-pair telephone lines in hybrid overvoltage protection devices that employ gas discharge tubes and MOVs electrically connected in parallel between the tip and ring conductors and a common electrical ground. Each gas tube and MOV provides an alternative electrical path to ground. The gas tube is often considered to be the primary electrical path between the corresponding signal line (e.g., tip or ring conductor in the case of twisted-pair telephone lines) and ground, because the gas tube is able to repeatedly withstand high current surges. However, because of the time required to ionize the gas in the gas tube, the response time of the MOV is significantly faster than the relatively slow response time of the gas tube. On the other hand, sustained or repeated currents tend to damage the MOV. In hybrid overvoltage protection devices employing interacting varistors, the parallel combination of the gas tube and the MOV permit the overvoltage protection device to respond to fast rise time surges or transients because the MOV will divert voltage surges to ground until the gas tube fires. The gas discharge tube provides the primary electrical path to ground and protects the MOV because the MOV will not be subjected to sustained or repeated high currents. In other hybrid overvoltage protection devices, an MOV having a much larger DC breakdown voltage than the gas tube provides back-up surge protection in case of damage to the gas tube (e.g., venting). This invention can be employed with either interacting or back-up type hybrid overvoltage protection devices.

Figure 1:
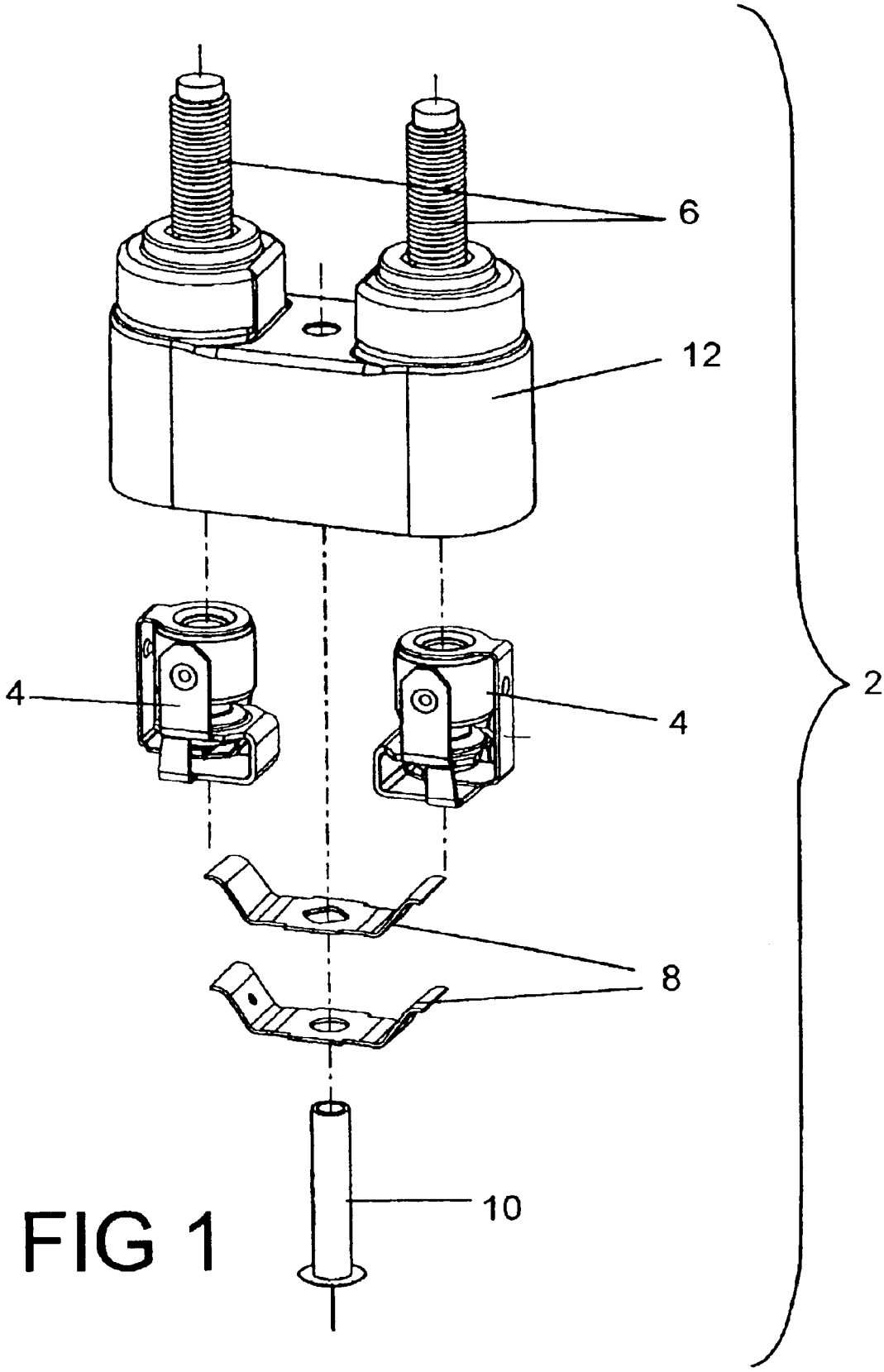
FIG. 1 is an exploded perspective view of an overvoltage protection device, and in particular, a station protector of the type that can be configured to employ metal oxide varistors (MOVs) according to this invention.
Figure 2:
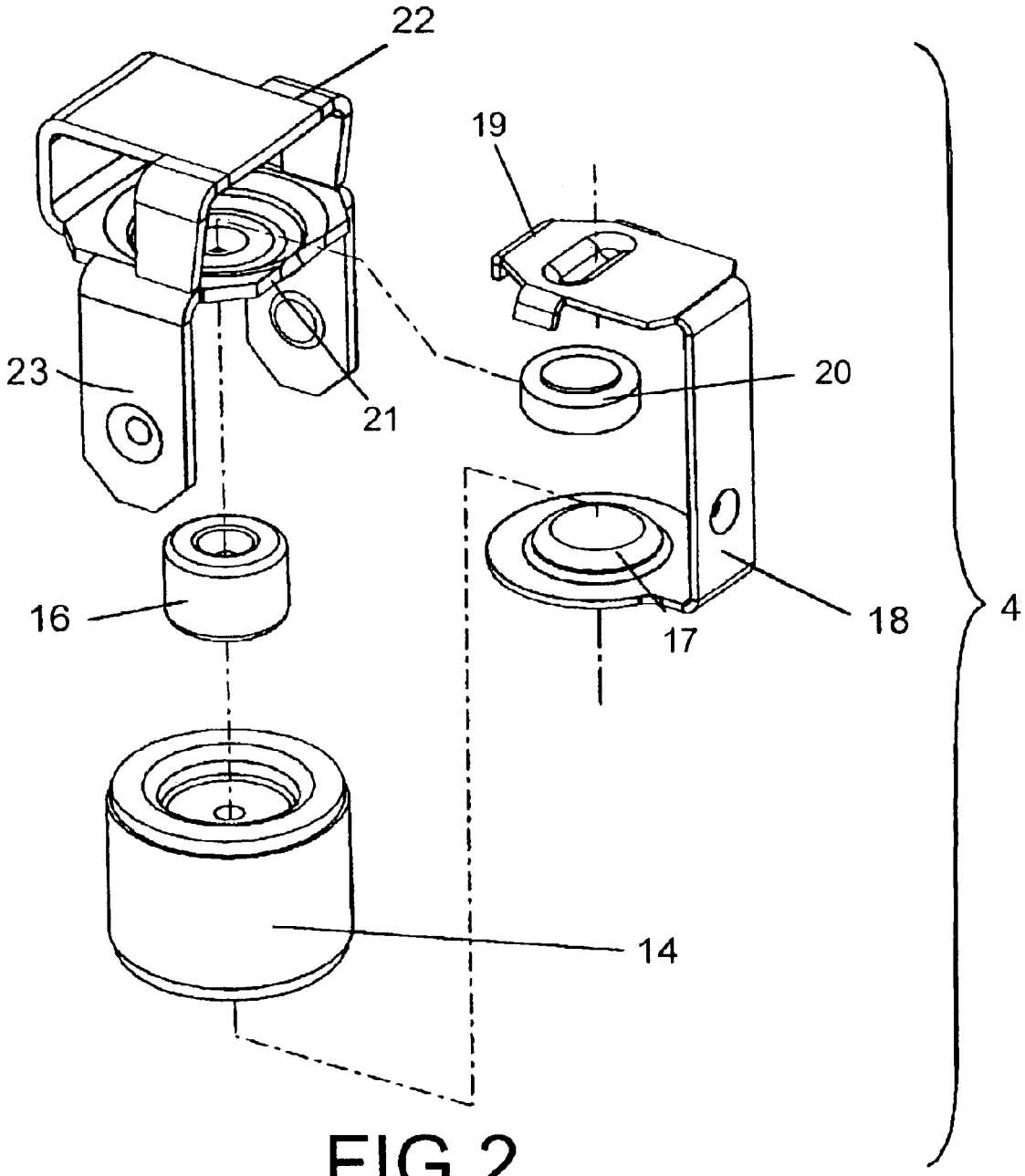
FIG. 2 is an exploded perspective view of a protector assembly including an MOV according to this invention that can be employed in the station protector shown in FIG. 1.

An example of a hybrid overvoltage protection device in the form of a station protector comprising a protector assembly employing a gas discharge tube and an MOV is shown in FIG. 1. The gas tube and the MOV are electrically connected in parallel between a signal line and ground. The protector assembly shown in FIG. 2 is commonly referred to as a two-element gas tube protector assembly. Three-element gas tube protector assemblies can also employ MOVs according to this invention, but need not be separately discussed because the invention is employed in the same manner for a two-element gas tube protector assembly as for a three-element gas tube protector assembly. The only significant difference between a three-element gas tube protector assembly and a two-element gas tube protector assembly is that the tip and ring conductors share a common gas chamber and a common ground terminal, as is well known in the art and therefore need not be described in greater detail.

Figure 3:
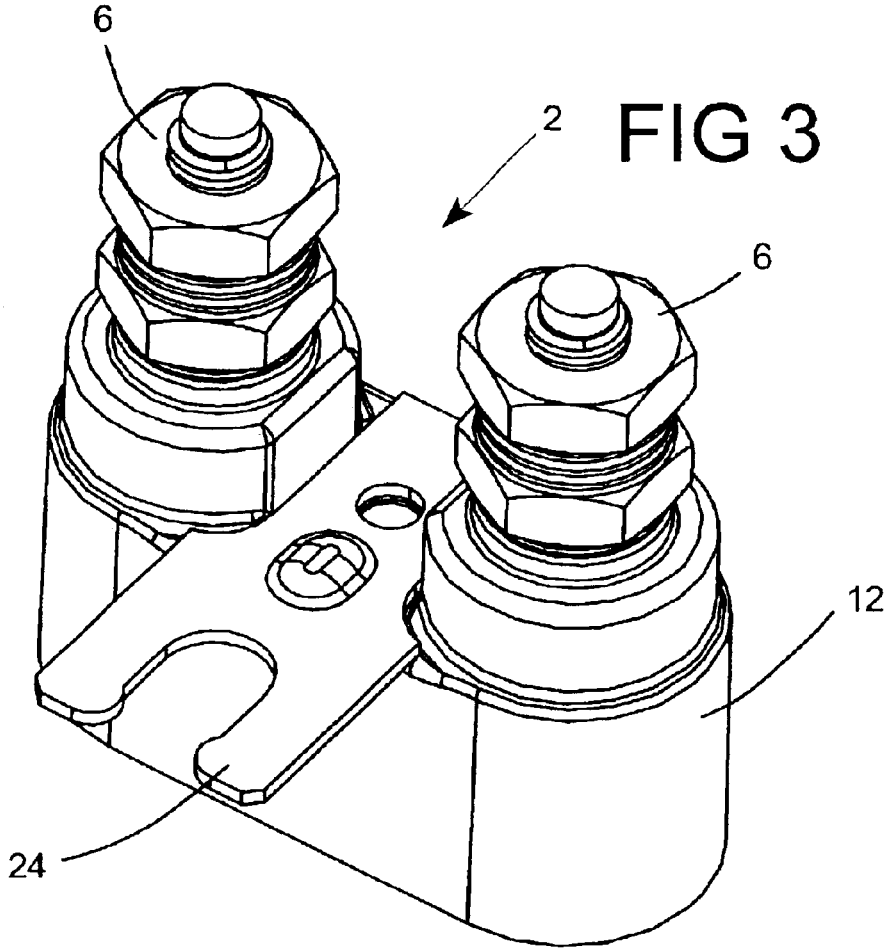
FIG. 3 is a perspective view of a fully assembled station protector according to this invention.

As shown in FIG. 1, station protector 2 comprises two protector assemblies 4 that are positioned within a generally hollow housing 12 in electrical contact with respective conductive terminals 6. Preferably, station protector 2 is of the type commercially available from Coming Cable Systems of Hickory, North Carolina, such as Model SPD126. The terminals 6 provide means for separately connecting the protector assemblies 4 to the tip conductor (not shown) and the ring conductor (not shown) of a twisted-pair telephone line suitable for use in a high frequency telecommunications network. The tip conductor is electrically connected to one of the terminals 6 and the ring conductor is electrically connected to the other terminal 6. A pair of ground springs 8 urge the protector assemblies 4 upwardly within the housing 12 into engagement with the lower ends of the respective terminals 6. A cylindrical conductive pin 10 has an annular flange in contact with and extending upwardly through the pair of ground springs 8. The pin 10 can be riveted in place to form at least a portion of an electrical path between each protector assembly 4 and a ground terminal, such as ground terminal 24, shown in FIG. 3.

The primary protector in the protector assembly 4 shown in FIG. 2 is a gas discharge tube 14. Accordingly, in the exemplary station protector shown in FIGS. 1 and 3, a first primary protector in the form of a gas discharge tube 14 is electrically connected between one of the terminals 6 and the ground terminal 24, and a second primary protector in the form of a gas discharge tube 14 is electrically connected between the other terminal 6 and the ground terminal 24. As is well known, inert gas within gas discharge tube 14 will ionize when subjected to a voltage surge of sufficient energy, thereby forming an electrical path between the signal line subjected to the voltage surge and ground. In the preferred embodiments of the invention shown herein, a conventional two-element gas discharge tube is utilized. However, a three-element gas discharge tube may also be used, as is well known in the art. In each protector assembly 4, the gas discharge tube 14 is electrically connected in parallel with at least one MOV 20. The varistor material forming the body of MOV 20 is substantially nonconductive below a pre-selected electrical energy, but rapidly becomes conductive when subjected to a voltage surge above the pre-selected energy. Thus, the gas discharge tube 14 and the MOV 20 form alternative parallel paths between a signal line electrically connected to terminal 6 and ground terminal 24 when the signal line is subjected to a voltage surge. In alternative embodiments of the invention not shown and described herein, other mechanical, electrical and solid state voltage clamping devices may be substituted for the gas discharge tube 14, such as an air gap, resistor, inductor, thyristor, diode, and the like.

An MOV spring 18 and a failsafe contact 22 formed from conductive materials retain the gas discharge tube 14 and the MOV 20. The MOV 20 is positioned between a top portion 19 of the MOV spring 18 and a central web 21 on the failsafe contact 22. The gas discharge tube 14 is positioned between the central web 21 and the bottom portion 17 of the MOV spring 18. The MOV spring 18 urges the MOV 20 toward the central web 21 of the failsafe contact 22. The electrodes on the opposite sides of the MOV 20 engage the lower surface of the top portion 19 of MOV spring 18 and the upper surface of the central web 21 of failsafe contact 22. However, the composition of the varistor material prevents conduction through the MOV 20 until the signal line is subjected to a voltage surge of sufficient energy for the varistor material to conduct and shunt the voltage surge to ground. A fusible member 16 is positioned between the central web 21 of the failsafe contact 22 and the gas discharge tube 14. The fusible member 16 is normally formed of a eutectic solder so that it will rapidly soften and flow when subjected to a predetermined temperature. However, the fusible member 16 may be made of any other suitable material that softens and flows sufficiently to permit the central web 21 of failsafe contact 22 to move in the direction of the gas discharge tube 14. Once the fusible member 16 softens and flows, the MOV spring 18 urges the failsafe contact 22 in the direction of the gas discharge tube 14 so that at least one leg 23 of failsafe contact 22 electrically contacts the terminal 6 and shorts the protector assembly 4 to the ground terminal 24 through ground springs 8 and pin 10, thereby diverting the voltage surge to electrical ground.

Since the MOV 20 is not conductive under normal circumstances, there will be a capacitance introduced primarily by the MOV 20 between the tip conductor and ground and between the ring conductor and ground. If these capacitances differ, there will be a capacitive imbalance that exists between the electrical path from the tip conductor to ground and the electrical path from the ring conductor to ground. Capacitive imbalance is typically not problematic at lower frequencies, but results in unacceptable signal loss (e.g., insertion loss and return loss) and longitudinal imbalance at higher frequencies. In particular, excessive capacitive imbalance results in inadequate performance at higher frequencies in a number of existing station protectors.

Overvoltage protection devices according to this invention are not limited to the station protector shown in FIGS.

1 and 3. However, station protectors of the type shown and described herein facilitate the use of twisted-pair telephone lines for xDSL communications by reducing any capacitive imbalance introduced between the tip conductor and ground and the ring conductor and ground due to the addition of the station protector. Although higher frequency transmissions are possible over twisted-pair telephone lines utilizing conventional station protectors that do not incorporate this invention, the variability of the capacitance of the MOVs employed in those station protectors results in an unacceptable number of station protectors that will not perform adequately for higher frequency transmissions. This inadequate performance at higher frequencies of some station protectors that perform satisfactorily for lower frequency transmissions requires replacement of at least some existing station protectors before satisfactory xDSL communications can be achieved.

When the overvoltage protection device is to be used to form separate electrical paths to ground for two conductors, such as the tip and ring conductors of a twisted-pair telephone line, capacitive imbalance becomes an issue. In station protectors used to shunt voltage surges from the tip conductor to ground and/or from the ring conductor to ground at the network interface to the customer premises, separate MOVs are used between tip and ground and between ring and ground. If the capacitances of these two MOVs differ, capacitive imbalance is introduced between the tip and ring conductors.

Figure 4:
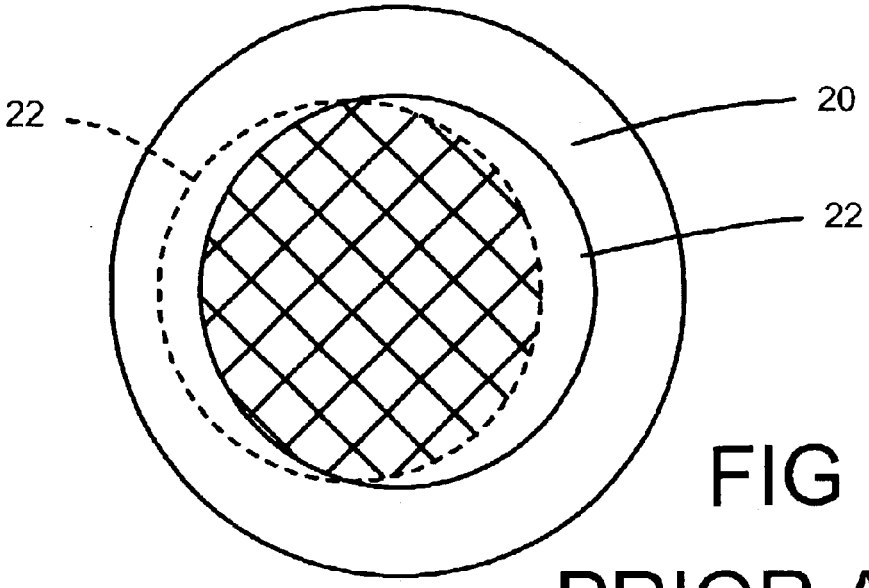
FIG 4 PRIOR ART
FIG. 4 is an enlarged plan view of a prior art MOV with electrodes on opposite sides of the varistor material that are laterally displaced such that the overlapped surface area of the electrodes is less than the surface area of either electrode.
Figure 5:
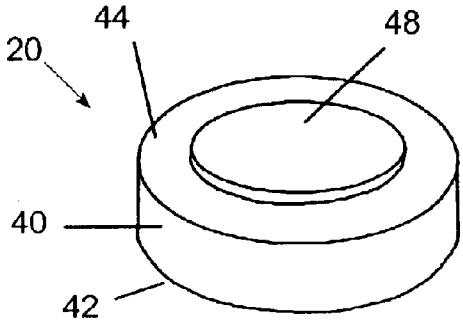
FIG. 5 is an enlarged perspective view showing the smaller of two asymmetrical electrodes on an MOV that can be used in the protector assembly shown in FIG. 2.
Figure 6:
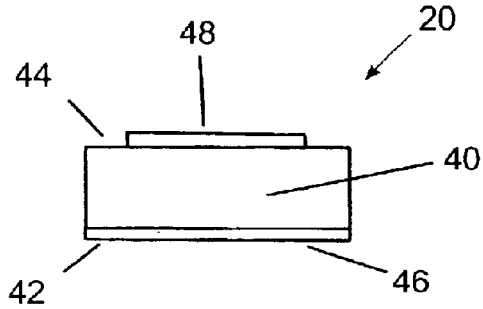
FIG. 6 is an enlarged side view showing both the smaller electrode and the larger electrode of the asymmetrical MOV shown in FIG. 5.
Figure 7:
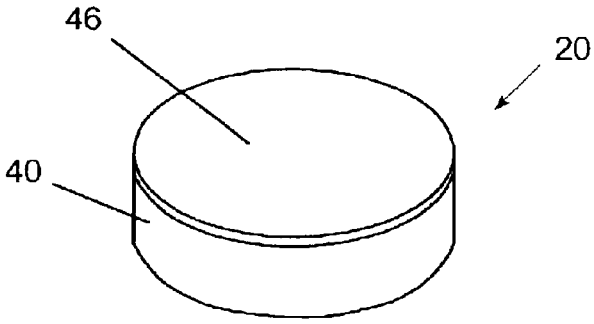
FIG. 7 is an enlarged perspective view showing the larger electrode of the asymmetrical MOV shown in FIG. 5 and FIG. 6.

MOVs of the type used in overvoltage protection devices, such as station protectors, statistically exhibit a large capacitive tolerance. One reason for the relatively large capacitive tolerance of MOVs is misalignment of the electrodes on opposite sides of the varistor material. Misalignment can occur when the electrodes are laterally displaced, or when one or both of the electrodes is misshapen (e.g., not concentric). The electric field generated between the electrodes will not be the same when the electrodes are misaligned as when the electrodes are properly aligned because the overlapped surface area of the electrodes will be different. Since capacitance is a function of the electric field generated in a nonconductive material between two spaced apart, conductive electrodes, the capacitance will also be a function of the relative alignment of the two electrodes. The varistor material will be nonconductive under normal conditions. Therefore, the capacitance introduced by an MOV is a function of the electric field generated between two electrodes that cannot be positioned relative to each other consistently with a level of precision that does not adversely affect higher frequency transmissions, such as xDSL communications. The exact placement of the electrodes on opposite sides of the MOV cannot be adequately controlled by conventional manufacturing techniques. FIG. 4 is an enlarged view of a prior art MOV 20 in which symmetrical electrodes 22 having the same size surface area on opposite sides of the varistor material (i.e., symmetrical electrodes) are laterally displaced. The overlapped surface area, shown cross-hatched in FIG. 4, is not as large as the surface area of either electrode. Thus, the capacitance introduced by the MOV 20 will differ from the capacitance of an MOV in which the electrodes are more closely aligned.

A 5 mm, 230V MOV with symmetrical electrodes has a capacitance of about 60 picofarads. However, the capacitive tolerance of these MOVs is typically 20%, meaning that the capacitance can range from about 48 picofarads to about 72 picofarads for MOVs that afford the same surge protection (i.e., 60 picofarads ±12 picofarads). This large tolerance is believed to be attributable primarily to manufacturing difficulties that lead to misalignment of the electrodes on opposite sides of the MOV. The difference in capacitance of an MOV between tip and ground and of an MOV between ring and ground, however, must be significantly less than the above range for the station protector to not adversely affect xDSL transmissions over a twisted-pair telephone line. It has been determined empirically that improved xDSL performance can be achieved if the capacitive imbalance introduced between tip to ground and ring to ground by a station protector does not exceed about 1.3 picofarads. It has also been determined that if MOVs are sorted into subgroups in which the capacitance of any two MOVs within that subgroup do not vary by more than 1.0 picofarad (i.e., the difference in capacitance between any two MOVs in the subgroup is no greater than 1.0 picofarad), and if both MOVs used in a station protector are selected from a common subgroup, than the capacitive imbalance introduced by the station protector will not exceed 1.3 picofarads. Even though this procedure will not necessarily reduce the amount of capacitance introduced between the tip conductor and ground or between the ring conductor and ground, nevertheless the reduction in capacitive tolerance (and therefore, capacitive imbalance) will result in a desirable improvement in the performance of the station protector for higher frequency xDSL communications.

Figure 9:
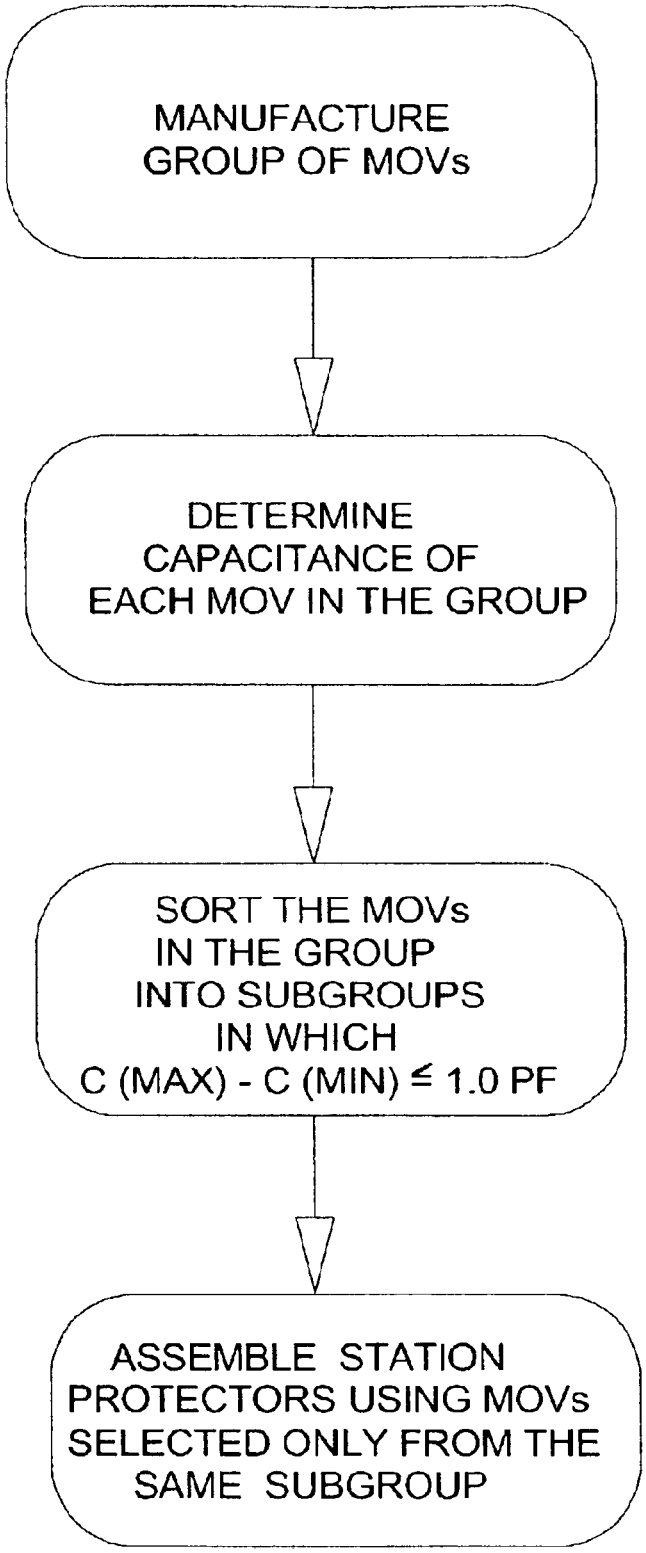
FIG. 9 is a flow chart illustrating a method according to this invention for assembling station protectors employing symmetrical MOVs sorted into subgroups so that the capacitive imbalance for each station protector will not be excessive.

Assembly of station protectors in accordance with a first aspect of the invention includes the steps illustrated in FIG. 9. The capacitances of a plurality of manufactured MOVs can be readily determined by known means prior to incorporation of the MOVs into station protectors. In accordance with a preferred embodiment of this invention, MOVs forming a group of otherwise identically manufactured MOVs are sorted into subgroups in which the capacitances of any two MOVs within the subgroup do not vary by more than 1.0 picofarad. In other words, the difference between the capacitance of the MOV within the subgroup having the greatest capacitance and the capacitance of the MOV within the subgroup having the least capacitance is less than or equal to 1.0 picofarad. In FIG. 9, the greatest capacitance in the subgroup is identified as "C (MAX)" and the least capacitance in the subgroup is identified as "C (MIN)." Station protectors in accordance with this invention are then assembled using only MOVs selected from the same subgroup for the tip to ground and the ring to ground protector assemblies 4 used in the same station protector 2. Station protectors 2 can be assembled in this manner using a predetermined subgroup to supply MOVs for all station protectors 2 in a particular production run. Thus, MOVs from each subgroup are used to produce station protectors 2 in which the capacitive imbalance does not exceed 1.3 picofarads. Furthermore, this method allows the eventual use of all MOVs within the tolerance range dictated by manufacturing considerations. It should be noted that the goal of limiting capacitive imbalance for station protectors to less than about 1.3 picofarads by sorting MOVs into subgroups having no more than a 1.0 picofarad difference in capacitance represents a compromise between improved performance and economic considerations, including the cost of identifying and replacing station protectors after they have been placed in service. However, the methods of sorting manufactured MOVs described herein are not limited to the specific capacitance and capacitive imbalance values enumerated herein. Relatively larger or smaller improvement can be achieved by adopting different numerical criteria. Therefore, the invention, at least in its broader aspects, is not limited to the specific capacitance and capacitive imbalance capacitance values employed in the preferred embodiments shown and described herein.

Although improved performance can be achieved by sorting MOVs in the above manner, at least two factors limit the practicality of utilizing the method. First, even though sorting MOVs into subgroups leads to a reduction in the capacitive imbalance in an overvoltage protection device, there is typically no reduction in the magnitude of the capacitances introduced between the tip conductor and ground or between the ring conductor and ground. A reduction in the magnitude of the capacitances would lead to an even further improvement in the performance of a station protector for higher frequency transmissions, such as xDSL communications, and particularly for very high speed digital subscriber lines (VDSL) communications. Capacitances of about 30 picofarads instead of the current nominal value of about 60 picofarads for standard 5 mm MOVs would be very desirable for higher frequency transmissions, and especially VDSL communications.

A second limitation on the degree of improvement that can be achieved by sorting manufactured MOVs to reduce capacitive imbalance is economic in nature. Sorting MOVs into subgroups in which the difference in capacitance is no greater than 1.0 picofarad to achieve improved performance at higher frequencies is relatively costly when the tolerance in capacitance is as much as 24 picofarads, as is the case of 5 mm MOVs with a nominal capacitance of about 60 picofarads and a tolerance of about ±20%. Indeed, it has been suggested by some manufacturers that it is economically impractical to sort MOVs having such a large tolerance of capacitance in this manner. Even if the variation in capacitance for a given production run is considerably less than 24 picofarads, it is still difficult and costly to sort MOVs having a large variation in capacitance into a plurality of subgroups each confined to a range of only 1.0 picofarad. For a given production run, it is reasonable to anticipate that the MOVs fabricated during that same run will exhibit a capacitance predominately clustered about a mean value somewhere within the 20% tolerance range. However, it is quite difficult to anticipate that mean value in advance, and experience has shown that the mean value can be expected to vary significantly between production runs, even without intervening tooling changes. Furthermore, the distribution (i.e., the standard deviation of the capacitance) has been found to be so large that MOVs fabricated in the same production run will rarely, if ever, be limited to a single subgroup. For instance, it has been determined empirically that approximately 20% of the MOVs manufactured in a given production run cannot be included in the same subgroup as the remaining MOVs manufactured in that same production run. Accordingly, those MOVs must be discarded or put aside for use in subgroups compiled from other production runs Experience has also shown that station protectors containing two or more MOVs from the same production run that are not sorted as described above, result in a final inspection rejection rate of between about 7% and about 10%. This rejection rate of production station protectors is economically unacceptable and clearly exceeds the additional expense of sorting the MOVs from each production run.

The further limitations described above can be overcome in accordance with a second aspect of this invention. The magnitude of the capacitance of each MOV can be lowered by manufacturing MOVs with a smaller electrode on one side of the varistor material and a larger electrode on the opposite side of the varistor material. Such MOVs are referred to herein as "asymmetrical MOVs" or "MOVs with asymmetrical electrodes." The distribution of the capacitance of asymmetrical MOVs is sufficiently reduced such that the MOVs manufactured in a given production run can be sorted into a practical number of subgroups in which the capacitances of any two MOVs vary by no more than 1.0 picofarad. Furthermore, the standard deviation of the capacitance for a group of asymmetrical MOVs is less than the standard deviation of the capacitance for a group of symmetrical MOVs. Thus, a greater percentage of the asymmetrical MOVs produced in a given production run will satisfy the 1.0 picofarad requirement. Assuming the material, thickness and overall diameter of the asymmetrical MOVs is the same as the symmetrical MOVs, the asymmetrical MOVs will be capable of handling a sustained voltage surge of the same electrical energy.

MOVs with asymmetrical electrodes will both reduce capacitance and will have less variability in capacitance (referred to herein as capacitive tolerance) than MOVs having symmetrical electrodes. FIGS. 5–8 show one embodiment of an MOV 20 with asymmetrical electrodes 46 and 48 on opposite sides of a body 40 formed of a varistor material, such as zinc oxide or other semi-conductive material used in the manufacture of conventional MOVs. The larger electrode 46 covers substantially the entire surface of the side 42 of the body 40. The smaller electrode 48, however, covers only a portion of the surface of the opposite side 44 of the body 40. Opposite electrodes 46, 48 are substantially parallel and, with the exception of the fact that the first electrode 46 is larger than the second electrode 48, the MOV 20 is of conventional construction. Electrodes 46 and 48 are positioned on the sides 42 and 44 of the body 40 using any one of a number of known fabrication techniques. For example, in the preferred embodiments of the MOVs 20 shown and described herein, the electrodes 46 and 48 are vapor deposited onto the outwardly facing surfaces of sides 42 and 44, respectively.

Figure 8:
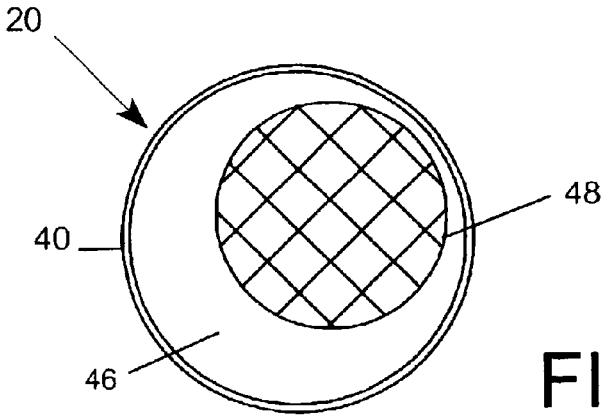
FIG. 8 is an enlarged plan view of an asymmetrical MOV wherein the overlapped surface area of the two electrodes is represented by cross-hatching.

In one embodiment, an asymmetrical MOV 20 has a diameter of about 5 mm, and the larger electrode 46, which covers substantially the entire surface of the side 42, also has a diameter of about 5 mm. As previously mentioned, MOVs of the type used in conventional station protectors typically have a diameter of only about 3.8 mm. Since the larger electrode 46 covers substantially the entire side 42 of the varistor material, it will completely overlap the surface area of the smaller electrode 48, regardless of its size, shape or lateral placement on side 44. FIG. 8 shows that the overlapped surface area of the two electrodes 46, 48 represented by the cross-hatched area 47 will always be equal to the surface area of the smaller electrode 48, even if the smaller electrode is laterally displaced relative to the center of the body 40. For purposes of illustration only, this lateral displacement is greatly exaggerated in FIG. 8. In the embodiment shown in FIGS. 5–8, the diameter of the smaller electrode 48 is preferably about 1.9 mm, which is approximately the same size as the electrodes of a conventional 3 mm MOV with symmetrical electrodes. Given the same thickness of varistor material, the asymmetrical MOV 20 will therefore have a capacitance that is substantially less (typically about one-half) the capacitance of a conventional 5 mm symmetrical MOV, but will have a greater current handling capacity than a smaller MOV. It is not necessary that the larger electrode 46 cover the entire surface of the side 42 of the varistor material, as shown herein. In. fact, manufacturing considerations may require in certain cases that the larger electrode 46 be at least slightly smaller than the side 42. In an alternative 5 mm asymmetrical MOV, for example, a larger electrode 46 having a diameter of about 3.5 mm is used with a smaller electrode 48 having a diameter of about 1.9 mm to achieve a significant reduction in both capacitance and capacitive tolerance.

Furthermore, the capacitance of the MOV can be varied by utilizing asymmetrical electrodes having different surface areas. For example, the capacitance of the MOV can be further reduced by reducing the surface area of the smaller electrode since the size and shape of the electric field generated between the two electrodes will be dependent upon the surface area of the smaller electrode, and will be relatively independent of the surface area of the larger electrode. Thus, use of an asymmetrical MOV with a smaller electrode overlapped by a larger electrode will further reduce both the capacitance of each MOV and the capacitive imbalance introduced in a station protector between the tip conductor and ground and between the ring conductor and ground as a result of the use of MOVs from the same subgroup.

Although the capacitive tolerance of MOVs can be reduced by manufacturing 5 mm, 230V MOVs with asymmetrical electrodes, it has been found that the variability of the capacitance is still too great to reliably produce station protectors that have a capacitive imbalance no greater than about 1.3 picofarads without sorting the MOVs prior to assembly. However, the capacitive tolerance for a given production run of asymmetrical MOVs is significantly less than the capacitive tolerance for a given production run of symmetrical MOVs, at least in part because of the absence of electrode misalignment. As a result of the smaller capacitive tolerance, it has been determined that it is both feasible and practical to sort asymmetrical MOVs into subgroups wherein the difference in the capacitances of any two MOVs is no greater than 1.0 picofarad.

Figure 10:
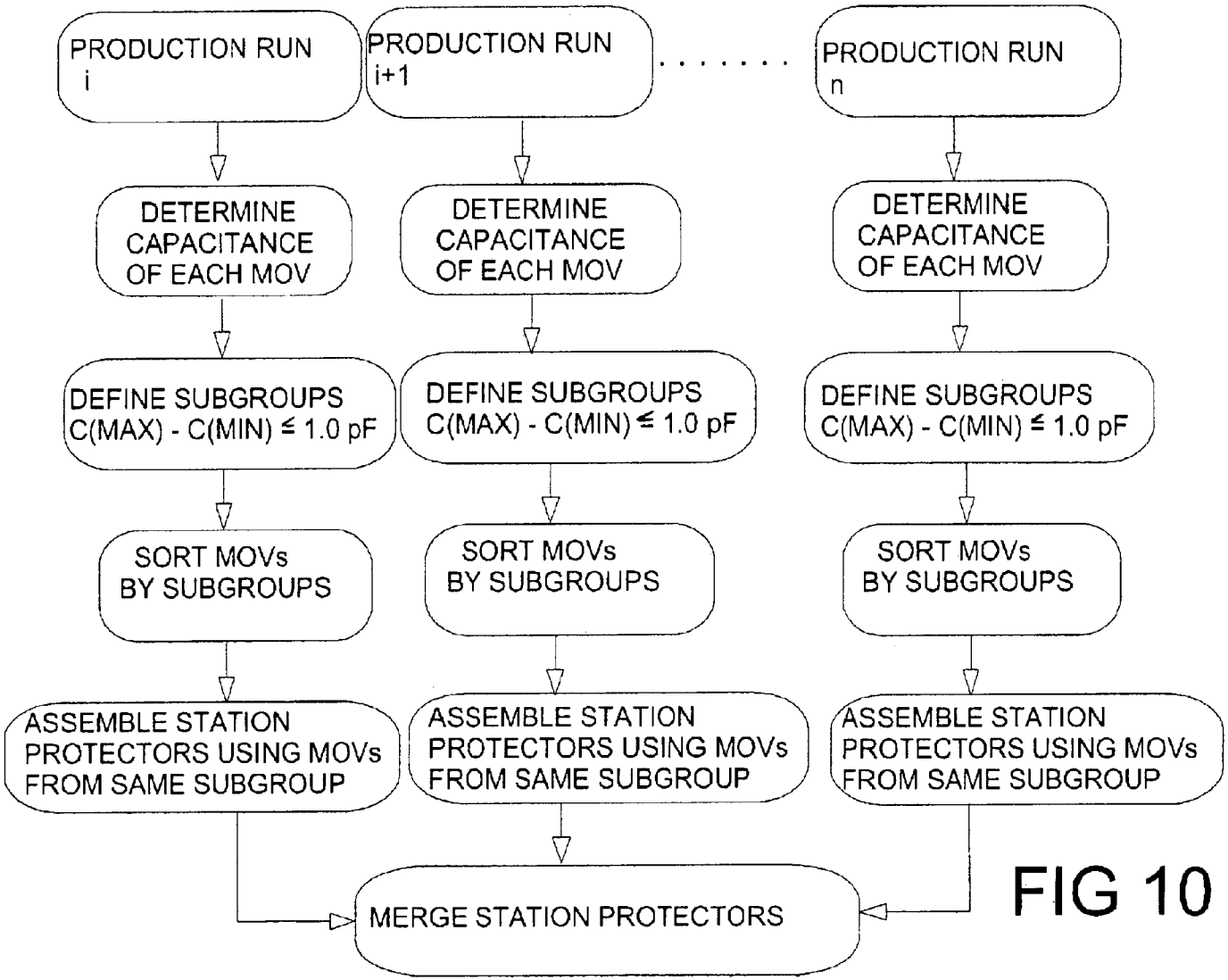
FIG. 10 is a flow chart illustrating another method according to this invention for assembling station protectors employing asymmetrical MOVs sorted into subgroups so that the capacitive imbalance for each station protector will not be excessive.

Station protectors 2 employing 5 mm, 230V asymmetrical MOVs that have a capacitance no greater than about 30 picofarads and a capacitive imbalance no greater than about 1.3 picofarads can be reliably and economically produced by another method according to the invention illustrated in FIG. 10. For each production run of asymmetrical MOVs, the MOVs are sorted into subgroups in which no MOV has a capacitance that differs by more than 1.0 picofarad from any other MOV within the same subgroup. The number of subgroups for each continuous production run will be relatively small because of the lower variability of capacitance exhibited by asymmetrical MOVs, and because relevant operational factors, including environmental factors and process variables, should remain substantially constant during the same run. These relevant operational factors can be expected to vary somewhat among different production runs, for example on subsequent days, even though no tooling changes may have been made between successive runs. Therefore, as used herein a continuous production run means a production cycle during which operational factors relevant to the capacitance of an MOV can be expected to not exhibit significant change. Typically the length of such a continuous production run is known from experience with the manufacture of conventional 5 mm, 230V symmetrical MOVs. It will also be possible to readily identify appropriate subgroups based on a small number of capacitance values. Statistically, virtually all of the asymmetrical MOVs manufactured in the same continuous production run can be divided into no more than two subgroups in which the difference in the capacitances of any two MOVs does not exceed 1.0 picofarad. If desired, the very few asymmetrical MOVs having capacitances that do not fit within this small number of subgroups can be discarded. At the end of each production run, the sorted subgroups of asymmetrical MOVs can be packaged as a unit and transported to the location where the station protectors 2 will be assembled.

Station protectors 2 are then assembled in a conventional manner, except that any two asymmetrical MOVs used in the same station protector 2 must be taken from a single sorted subgroup that contains only asymmetrical MOVs preferably manufactured in the same continuous production run. For the sake of consistency, MOVs manufactured during one production run generally are not sorted with MOVs manufactured during a different production run. This is primarily due to the fact that the 1.0 picofarad range of capacitances for the MOVs is separately determined for each production run. Thus, even though the capacitive tolerance (i.e., 1.0 picofarad) may be the same for all subgroups, the average (i.e., statistical mean) capacitance of the MOVs is likely to be somewhat different. Accordingly, the maximum and minimum capacitances within each subgroup can be unique for each production run. By segregating subgroups according to specific production runs, it becomes relatively simple to insure that the difference in capacitance between MOVs employed in the same station protector 2 will be less than 1.0 picofarad, and thus, that the capacitive imbalance between the tip conductor to ground and the ring conductor to ground circuits within the same station protector 2 will be no greater than 1.3 picofarads. The use of asymmetrical MOVs will also produce station protectors 2 with tip conductor and ring conductor capacitances no greater than about 30 picofarads. The resulting combination of reduced capacitance and reduced capacitive imbalance permits the fabrication of station protectors 2 with improved performance for higher frequency transmissions including xDSL communications, for example VDSL communications.

That which is claimed is:

1. A method of assembling an overvoltage protection device for use with a pair of signal lines such that the capacitive unbalance between the signal lines introduced by the overvoltage protection device is less than a predetermined first value, the method comprising the steps of:

determining the capacitance of each MOV in a group of MOVs, each MOV in the group being capable of protecting against a voltage surge;

sorting the MOVs into at least one subgroup consisting only of MOVs with capacitances that differ by no more than a predetermined second value; and assembling the overvoltage protection device using MOVs selected only from the same subgroup so that the capacitive imbalance of the overvoltage protection device does not exceed the first value, wherein the first value is about 1.3 picofarads and the second value is about 1.0 picofarad.

2. The method of claim 1 wherein a plurality of overvoltage protection devices are assembled using at least two MOVs selected only from each of a plurality of different subgroups and wherein the capacitive imbalance of each overvoltage protection device does not exceed the first value.

3. The method of claim 2 wherein the second value is the same for each subgroup.

4. The method of claim 1 wherein the first value is greater than the second value.

5. The method of claim 1 wherein the overvoltage protection device is a station protector.

6. The method of claim 5 wherein the station protector comprises at least one gas discharge tube and each of the MOVs is electrically connected in parallel with the at least one gas discharge tube.

7. The method of claim 1 wherein each MOV in the group of MOVs has a capacitance of about 60 picofarads with a tolerance of about ±12 picofarads and wherein the first value is substantially less than the tolerance.

8. The method of claim 1 wherein each of the MOVs comprises a body having a first side and a second side opposite the first side, a first electrode disposed on the first side of the body and a second electrode disposed on the second side of the body and wherein the surface area of the second electrode is substantially equal to the surface area of the first electrode.

9. The method of claim 1 wherein each of the MOVs comprises a body having a first side and a second side opposite the first side, a first electrode disposed on the first side of the body and a second electrode disposed on the second side of the body and wherein the surface area of the second electrode is smaller than the surface area of the first electrode so that the overlapped surface area of the electrodes is smaller than the surface area of the first electrode.

10. An overvoltage protection device for use with a pair of signal lines such that the capacitive imbalance between the signal lines introduced by the overvoltage protection device is less than a predetermined first value, the overvoltage protection device being assembled by the process of:

sorting a group of MOVs into at least one subgroup wherein the difference in the capacitances of any two MOVs in the subgroup is no more than a predetermined second value; and assembling the overvoltage protection device using MOVs selected only from the same subgroup so that the capacitive imbalance between the signal lines introduced by the overvoltage protection device is less than a predetermined second value, wherein each MOV in the group of MOVs has a capacitance of about 60 picofarads with a tolerance of about ±12 picofarads and wherein the first value is substantially less than the tolerance.

11. The overvoltage protection device of claim 10 wherein a plurality of overvoltage protection devices are assembled using at least two MOVs selected only from each of a plurality of different subgroups and wherein the capacitive imbalance of each overvoltage protection device does not exceed the first value.

12. The overvoltage protection device of claim 11 wherein the second value is the same for each subgroup.

13. The overvoltage protection device of claim 10 wherein the first value is greater than the second value.

14. The overvoltage protection device of claim 10 wherein the overvoltage protection device is a station protector.

15. The overvoltage protection device of claim 14 wherein the station protector comprises at least one gas discharge tube and each of the MOVs is electrically connected in parallel with the at least one gas discharge tube.

16. The overvoltage protection device of claim 10 wherein the first value is about 1.3 picofarads and the second value is about 1.0 picofarad.

17. The overvoltage protection device of claim 10 wherein each of the MOVs comprises a body having a first side and a second side opposite the first side, a first electrode disposed on the first side of the body and a second electrode disposed on the second side of the body and wherein the surface area of the second electrode is substantially equal to the surface area of the first electrode.

18. The overvoltage protection device of claim 10 wherein each of the MOVs comprises a body having a first side and a second side opposite the first side, a first electrode disposed on the first side of the body and a second electrode disposed on the second side of the body and wherein the surface area of the second electrode is smaller than the surface area of the first electrode so that the overlapped surface area of the electrodes is smaller than the surface area of the first electrode.

19. A station protector for protecting against a voltage surge on a twisted-pair telephone line comprising tip and ring conductors used for digital subscriber line (DSL) transmissions, the station protector comprising a ground terminal;

first and second terminals electrically connected to the tip and ring conductors;

a first MOV electrically connected between the first terminal and the ground terminal; and a second MOV electrically connected between the second terminal and the ground terminal;

the first MOV and the second MOV selected from a subgroup of a group of MOVs wherein the difference between the capacitances of any two MOVs in the subgroup is no greater than a predetermined first value so that the capacitive imbalance between the first terminal and ground and the second terminal and ground does not exceed a predetermined second value, wherein the first value is about 1.0 picofarad and the second value is about 1.3 picofarads.

20. The station protector of claim 19 wherein the first MOV and the second MOV each comprise a body having a first side and a second side opposite the first side, a first electrode disposed on the first side and a second electrode disposed on the second side and wherein the surface area of the second electrode is substantially equal to the surface area of the first electrode.

21. The station protector of claim 19 wherein the first MOV and the second MOV each comprise a body having a first side and a second side opposite the first side, a first electrode disposed on the first side and a second electrode disposed on the second side and wherein the surface area of the second electrode is smaller than the surface area of the first electrode so that the overlapped surface area of the electrodes is smaller than the surface area of the first electrode.

22. The station protector of claim 21 wherein the capacitance of the first MOV and the capacitance of the second MOV are less than about 30 picofarads.

* * * * *